US011466650B2

(12) United States Patent
Ogawa et al.

(10) Patent No.: US 11,466,650 B2
(45) Date of Patent: Oct. 11, 2022

(54) FUEL INJECTION VALVE DRIVING DEVICE

(71) Applicants: KEIHIN CORPORATION, Tokyo (JP); Panasonic Intellectual Property Management Co., Ltd., Osaka (JP)

(72) Inventors: Atsushi Ogawa, Shioya-gun (JP); Motoaki Kato, Shioya-gun (JP); Kengo Nomura, Shioya-gun (JP); Keisuke Kuroda, Osaka (JP); Takashi Ryu, Kyoto (JP)

(73) Assignees: HITACHI ASTEMO, LTD., Hitachinaka (JP); PANASONIC SEMICONDUCTOR SOLUTIONS CO., LTD., Nagaokakyo (JP)

( * ) Notice: Subject to any disclaimer, the term of this patent is extended or adjusted under 35 U.S.C. 154(b) by 327 days.

(21) Appl. No.: 16/708,821

(22) Filed: Dec. 10, 2019

(65) Prior Publication Data

US 2020/0191105 A1 Jun. 18, 2020

(30) Foreign Application Priority Data

Dec. 14, 2018 (JP) ..... JP2018-234459

(51) Int. Cl.
*F02M 51/00* (2006.01)
*F02D 41/30* (2006.01)
*B05B 1/30* (2006.01)

(52) U.S. Cl.
CPC ..... *F02M 51/005* (2013.01); *B05B 1/3053* (2013.01); *F02D 41/30* (2013.01)

(58) Field of Classification Search
CPC ..... F02M 51/00; F02M 51/005; F02D 41/30
See application file for complete search history.

(56) References Cited

U.S. PATENT DOCUMENTS 4,355,619 A * 10/1982 Wilkinson ..... F02D 41/20 123/490
4,486,703 A * 12/1984 Henrich ..... H03K 17/64 323/222

(Continued)

FOREIGN PATENT DOCUMENTS

CN 105143742 A 12/2015
CN 107710354 A 2/2018

(Continued)

OTHER PUBLICATIONS

CNIPA First Office Action for corresponding CN Application No. 201911272187.X; dated Dec. 28, 2021.

*Primary Examiner* — John Kwon
*Assistant Examiner* — Johnny H Hoang
(74) *Attorney, Agent, or Firm* — Cantor Colburn LLP

(57) ABSTRACT

This fuel includes: a first switching element disposed between a booster circuit boosting a battery power and one end of a solenoid; a second switching element disposed between a battery and one end of the solenoid; a third switching element disposed between the other end of the solenoid and a ground; a fourth switching element disposed between one end of the solenoid and a ground; and a control unit configured to control open/closed states of the first switching element, the second switching element, the third switching element, and the fourth switching element. The control unit is configured to open the fourth switching element during a valve closing detection period of detecting closing of a fuel injection valve and to detect the closing of the fuel injection valve on the basis of a change in voltage of the other end of the solenoid.

7 Claims, 4 Drawing Sheets

(56) References Cited

U.S. PATENT DOCUMENTS

| | | | | |
|---|---|---|---|---|
| 6,031,707 | A * | 2/2000 | Meyer | F02D 41/20 361/153 |
| 8,063,594 | B2 * | 11/2011 | Motoda | H05K 1/144 318/400.01 |
| 2008/0294324 | A1 * | 11/2008 | Yoshinari | F02D 41/20 701/102 |
| 2016/0076498 | A1 | 3/2016 | Aono et al. | |
| 2016/0208725 | A1 * | 7/2016 | Fukuda | F02D 41/20 |
| 2016/0265469 | A1 * | 9/2016 | Harada | F02M 51/061 |
| 2017/0089292 | A1 * | 3/2017 | Nishida | F02D 41/22 |
| 2018/0141506 | A1 | 5/2018 | Yamashita | |

FOREIGN PATENT DOCUMENTS

| | | | |
|---|---|---|---|
| JP | 2018093044 | A | 6/2018 |
| JP | 6383760 | B2 | 8/2018 |

* cited by examiner

FUEL INJECTION VALVE DRIVING DEVICE

CROSS REFERENCE TO RELATED APPLICATION

The present invention claims priority under 35 U.S.C. § 119 to Japanese Patent Application No. 2018-234459, filed on Dec. 14, 2018, the entire content of which is incorporated herein by reference.

BACKGROUND OF THE INVENTION

Field of the Invention

The present invention relates to a fuel injection valve driving device.

Description of Related Art

For example, Japanese Patent Publication No. 6383760 discloses a control device of an internal combustion engine provided with a fuel injection valve with a solenoid. The control device disclosed in Japanese Patent Publication No. 6383760 is used to control the internal combustion engine by driving the solenoid of the fuel injection valve and includes a plurality of switching elements for switching a power supplying state from a booster circuit or a battery to the solenoid.

SUMMARY OF THE INVENTION

In Japanese Patent Publication No. 6383760, the timing when the valve body comes into contact with the valve seat due to the interruption of the current supplied to the solenoid is detected on the basis of a voltage between a ground potential side terminal of the solenoid and a ground potential.

Incidentally, in Japanese Patent Publication No. 6383760, a recirculation path for returning a counter electromotive current output from the solenoid from the ground to the solenoid through a diode is provided and a diode is provided in the recirculation path. For this reason, since the Vf of the diode changes due to environmental factors such as a counter electromotive current and a temperature, the voltage between the ground potential side terminal of the solenoid and the ground potential changes and hence a valve closed state cannot be accurately detected.

The present invention has been made in view of the above-mentioned problems and an object thereof is to more accurately detect closing of a fuel injection valve using a change in voltage of one terminal of a solenoid in a fuel injection valve driving device with the solenoid.

The present invention employs the following configuration for solving the above-mentioned problems.

According to a configuration of a first aspect, a fuel injection valve driving device for driving a fuel injection valve with a solenoid, including: a first switching element which is disposed between a booster circuit boosting a battery power and one end of the solenoid; a second switching element which is disposed between a battery and one end of the solenoid; a third switching element which is disposed between the other end of the solenoid and a ground; a fourth switching element which is disposed between one end of the solenoid and a ground; and a control unit which is configured to control open/closed states of the first switching element, the second switching element, the third switching element, and the fourth switching element, wherein the control unit is configured to open the fourth switching element during a valve closing detection period of detecting closing of the fuel injection valve and to detect the closing of the fuel injection valve on the basis of a change in voltage of the other end of the solenoid.

According to a second aspect, in the first aspect, the control unit is configured to switch the fourth switching element from a closed state to an open state after detecting that the first switching element and the second switching element are closed.

According to a third aspect, in the first or second aspect, the control unit is configured to switch the first switching element or the second switching element from a closed state to an open state after detecting that the fourth switching element has been switched from an open state to a closed state.

According to a fourth aspect, in any one of the first to third aspects, the fourth switching element is a field effect transistor, and the control unit is configured to detect that the fourth switching element is closed on the basis of a gate voltage of the fourth switching element.

According to a fifth aspect, in any one of the first to fourth aspects, the closed state of the first switching element and the second switching element is detected on the basis of a voltage of a wiring on the side of the solenoid commonly connected to the first switching element and the second switching element.

According to a sixth aspect, in any one of the first to fourth aspects, the first switching element and the second switching element are field effect transistors, and the control unit is configured to detect that the first switching element or the second switching element is closed on the basis of a voltage of a wiring connected to a gate terminal of the first switching element and a gate terminal of the second switching element.

According to a seventh aspect, in any one of the first to sixth aspects, the fuel injection valve driving device further includes an overcurrent detecting resistor which is disposed between a connection position between a source terminal of the first switching element and a source terminal of the second switching element and a connection position between one end of the solenoid and a drain terminal of the fourth switching element.

According to the above aspects, since the first switching element and the second switching element are closed and the fourth switching element is opened, the counter electromotive current occurring in the solenoid can be returned to the solenoid and one end side of the solenoid is clamped to a reference potential of the ground. As a result, it is possible to more accurately detect the closing of the fuel injection valve as compared with a case in which one end side is not clamped to the reference potential. Thus, according to the above aspects, it is possible to more accurately detect the closing of the fuel injection valve by a change in voltage of one end side terminal of the solenoid in the fuel injection valve driving device with the solenoid.

DETAILED DESCRIPTION OF THE INVENTION

Hereinafter, an embodiment of a fuel injection valve driving device according to the present invention will be described with reference to the drawings.

Figure 1:
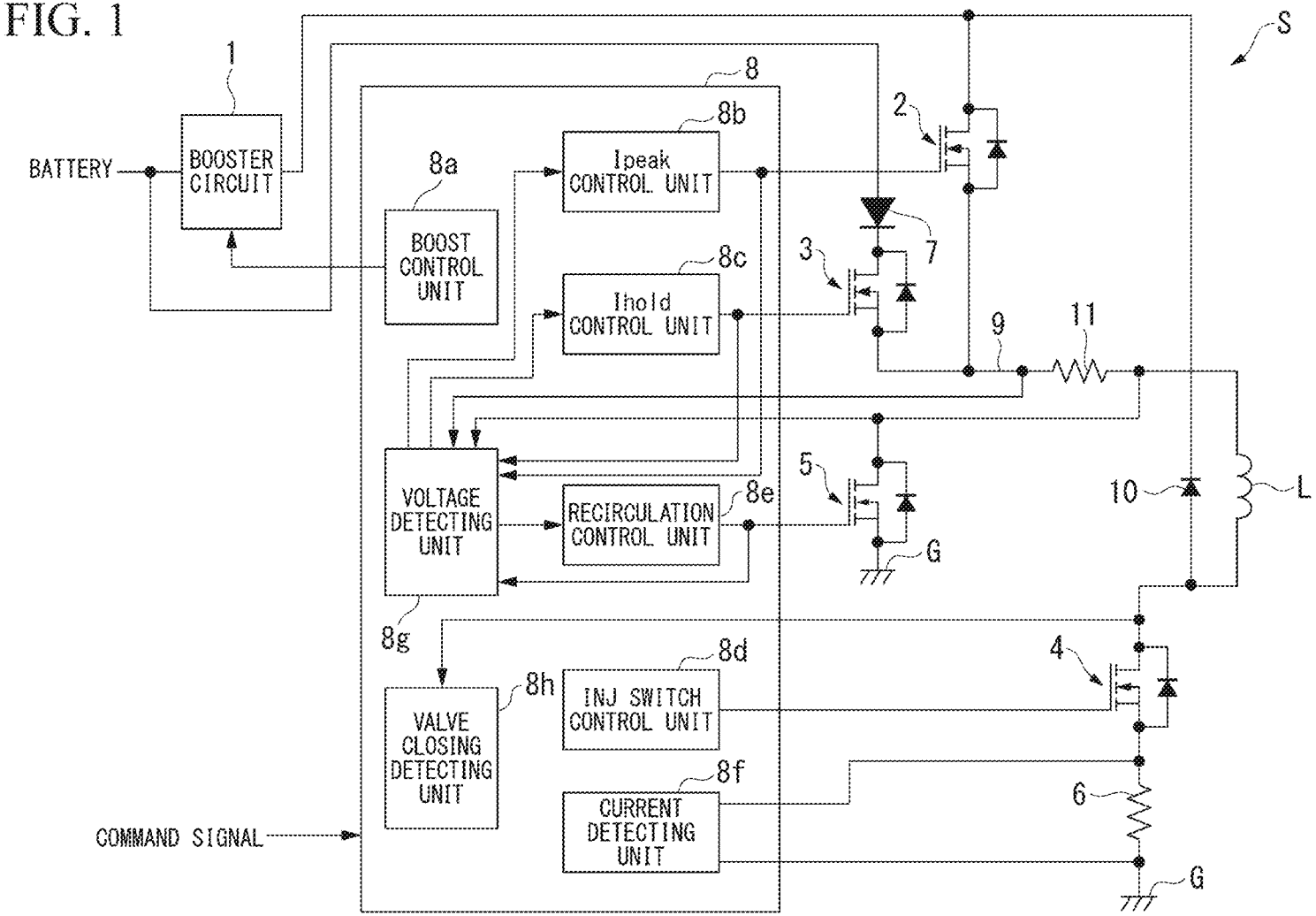
FIG. 1 is a schematic configuration diagram of a fuel injection valve driving device of an embodiment of the present invention.

FIG. 1 is a schematic configuration diagram of a fuel injection valve driving device S of the embodiment. As shown in this drawing, the fuel injection valve driving device S of the embodiment is a driving device for driving a solenoid L of a fuel injection valve and drives the fuel injection valve by supplying power supplied from an external battery to the solenoid L on the basis of a command signal input from the outside.

As shown in FIG. 1, the fuel injection valve driving device S includes a booster circuit 1, a first semiconductor switch 2 (a first switching element), a second semiconductor switch 3 (a second switching element), a third semiconductor switch 4 (a third switching element), a fourth semiconductor switch 5 (a fourth switching element), a current detecting resistor 6, a backflow preventing diode 7, a control unit 8, a boost regeneration diode 10, and an overcurrent detecting resistor 11.

The booster circuit 1 is a chopper circuit which boosts power input from a battery mounted on a vehicle to a predetermined target voltage. This booster circuit 1 has a boost ratio of, for example, about 2 to 10 and is controlled by a boost control unit 8*a* in the control unit 8.

The first semiconductor switch 2, the second semiconductor switch 3, the third semiconductor switch 4, and the fourth semiconductor switch 5 are field effect transistors, gate terminals thereof are connected to the control unit 8, and an open/close stated can be controlled by the control unit 8. In the embodiment, each of the first semiconductor switch 2, the second semiconductor switch 3, the third semiconductor switch 4, and the fourth semiconductor switch 5 uses a MOS transistor and has a parasitic diode as shown in FIG. 1.

The first semiconductor switch 2 is disposed between an output end of the booster circuit 1 and one end of the solenoid L (more precisely, one end of the solenoid coil). That is, in this first semiconductor switch 2, a drain terminal is connected to the output end of the booster circuit 1, a source terminal is connected to one end of the solenoid L, and a gate terminal is connected to an Ipeak control unit 8*b* of the control unit 8. The open/closed state of the first semiconductor switch 2 is controlled by the Ipeak control unit 8*b*.

The second semiconductor switch 3 is disposed between the battery and one end of the solenoid L (one end of the solenoid coil). That is, in this second semiconductor switch 3, a drain terminal is connected to the battery through the backflow preventing diode 7, a source terminal is connected to one end of the solenoid L, and a gate terminal is connected to an Ihold control unit 8*c* of the control unit 8. The open/closed state of such a second semiconductor switch 3 is controlled by the Ihold control unit 8*c*.

The third semiconductor switch 4 is disposed between the other end of the solenoid L (the other end of the solenoid coil) and a ground G (a reference potential). That is, in this third semiconductor switch 4, a drain terminal is connected to the other end of the solenoid L, a source terminal is connected to the ground G through the current detecting resistor 6, and a gate terminal is connected to an INJ switch control unit 8*d* of the control unit 8. The open/closed state of such a third semiconductor switch 4 is controlled by the INJ switch control unit 8*d*.

The fourth semiconductor switch 5 is disposed between one end of the solenoid L (one end of the solenoid coil) and the ground G. That is, in this fourth semiconductor switch 5, a drain terminal is connected to one end of the solenoid L, a source terminal is connected to the ground G, and a gate terminal is connected to a recirculation control unit 8*e* of the control unit 8. The open/closed state of such a fourth semiconductor switch 5 is controlled by the recirculation control unit 8*e*.

The current detecting resistor 6 is a current detecting resistor of which one end is connected to a source terminal of the third semiconductor switch 4 and the other end is connected to the ground G. That is, the current detecting resistor 6 is connected in series to the solenoid L (the solenoid coil) through the third semiconductor switch 4 and an energizing driving current flows to the solenoid L. In such a current detecting resistor 6 a voltage (a detection voltage) is generated in response to the magnitude of the driving current flowing across one end and the other end of the current detecting resistor 6.

Further, in the backflow preventing diode 7, a cathode terminal is connected to a drain terminal of the second semiconductor switch 3 and an anode terminal is connected to the output end of the battery. This backflow preventing diode 7 is an auxiliary component which is provided to prevent an output current of the booster circuit 1 from flowing to the output end of the battery through the second semiconductor switch 3 when any one of the first semiconductor switch 2 and the second semiconductor switch 3 is brought into an open state or through the parasitic diode of the second semiconductor switch 3 when only the second semiconductor switch 3 is in an off state (a closed state).

The control unit 8 is an integrated circuit (IC) which controls the booster circuit 1, the first semiconductor switch 2, the second semiconductor switch 3, the third semiconductor switch 4, and the fourth semiconductor switch 5, on the basis of a command signal input from a host control system. This control unit 8 includes the boost control unit 8*a*, the Ipeak control unit 8*b*, the Ihold control unit 8*c*, the INJ switch control unit 8*d*, the recirculation control unit 8*e*, a current detecting unit 8*f*, a voltage detecting unit 8*g*, and a valve closing detecting unit 8*h*, as functional units.

The boost control unit 8*a* generates a boost control signal (a PWM signal) for controlling the operation of the booster circuit 1 and outputs the signal to the booster circuit 1. The Ipeak control unit 8*b* generates a first gate signal for controlling the first semiconductor switch 2 and outputs the first gate signal to a gate terminal of the first semiconductor switch 2. The Ihold control unit 8*c* generates a second gate signal for controlling the second semiconductor switch 3 and outputs a second gate signal to a gate terminal of the second semiconductor switch 3. The INJ switch control unit 8*d* generates a third gate signal for controlling the third semiconductor switch 4 and outputs the third gate signal to a gate terminal of the third semiconductor switch 4. The recirculation control unit 8*e* generates a fourth gate signal for controlling the fourth semiconductor switch 5 and outputs the fourth gate signal to a gate terminal of the fourth semiconductor switch 5.

The current detecting unit 8*f* includes a pair of input ends, one input end is connected to one end of the current detecting resistor 6, and the other input end is connected to the other end of the current detecting resistor 6. That is, a detection voltage generated in the current detecting resistor 6 is input to this current detecting unit 8*f*. Such a current detecting unit 8*f* detects (calculates) the magnitude of the driving current on the basis of the detection voltage.

The voltage detecting unit 8*g* is connected to the gate terminal of the fourth semiconductor switch 5 and detects a gate voltage of the fourth semiconductor switch 5. The voltage detecting unit 8*g* outputs the gate voltage of the fourth semiconductor switch 5 to the Ipeak control unit 8*b* and the Ihold control unit 8*c*. Further, as shown in FIG. 1, a common wiring portion 9 is provided so as to be connected to a source terminal of the first semiconductor switch 2, a source terminal of the second semiconductor switch 3, and one end of the solenoid L. The voltage detecting unit 8*g* is connected to the common wiring portion 9 and detects the voltage of the common wiring portion 9. The voltage detecting unit 8*g* outputs the voltage of the common wiring portion 9 to the recirculation control unit 8*e*.

In the boost regeneration diode 10, a cathode is connected to the output end of the booster circuit 1 and an anode is connected to a drain terminal of the third semiconductor switch 4 and the other end of the solenoid L. The overcurrent detecting resistor 11 is disposed in the middle of the common wiring portion 9. More specifically, the overcurrent detecting resistor 11 is disposed on the common wiring portion 9 between a connection position between the source terminal of the first semiconductor switch 2 and the source terminal of the second semiconductor switch 3 and a connection position between one end of the solenoid L and a drain terminal of the fourth semiconductor switch 5. Since such an overcurrent detecting resistor 11 is provided, it is possible to detect a short circuit failure of the fourth semiconductor switch 5 and a ground fault on one end side of the injector (one end side of the solenoid L) on the basis of a difference in voltage between both ends of the overcurrent detecting resistor 11.

Figure 2:
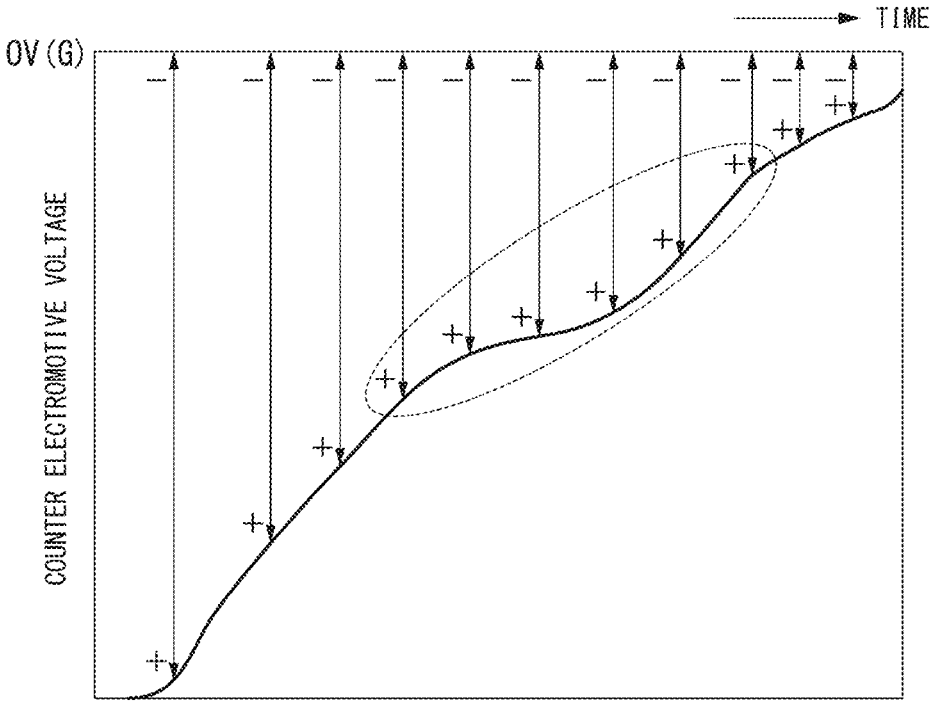
FIG. 2 is a graph showing change in voltage of the other end of a solenoid.

The valve closing detecting unit 8*h* is connected to the other end of the solenoid L and detects the closing of the fuel injection valve on the basis of a change in voltage of the other end of the solenoid L during a valve closing detection period. FIG. 2 is a graph showing a change in voltage of the other end of the solenoid L after the supply of the driving current to the solenoid L is stopped. When the supply of the driving current to the solenoid L is stopped, a counter electromotive force is generated in the solenoid L and a difference in voltage (a counter electromotive voltage) occurs between both ends of the solenoid L.

Such a counter electromotive force decreases with time and disappears after a certain period of time since the counter electromotive force is mainly consumed as heat when a return current flows to the ground G through the ground G, the fourth semiconductor switch 5, the parasitic diode of the fourth semiconductor switch 5, the solenoid L, the boost regeneration diode 10, the booster circuit 1, and the battery. Until such a difference in voltage disappears, a valve body of the fuel injection valve having been opened collides with a valve seat to be closed and a decreasing gradient of the difference in voltage changes when the valve body collides with the valve seat. For this reason, the valve closing detecting unit 8*h* detects the closing of the fuel injection valve by detecting a bending point (indicated by a dotted line) in the graph of FIG. 2. In the embodiment, a predetermined period before and after the estimated time at the moment when the valve body collides with the valve seat is set as a valve closing detection period and the recirculation control unit 8*e* opens the fourth semiconductor switch 5 during this period. As a result, one end of the solenoid L is connected to the ground G through the fourth semiconductor switch 5 and is clamped to a reference voltage and the difference in voltage occurs only at the other end side of the solenoid L as shown in FIG. 2. For this reason, since the bending point becomes steep as the change in voltage at the other end side of the solenoid L increases, it is possible to accurately detect the closing of the fuel injection valve by the valve closing detecting unit 8*h*. Furthermore, the recirculation control unit 8*e* opens the fourth semiconductor switch 5 after detecting that the voltage of the common wiring portion 9 has decreased (the first semiconductor switch 2 and the second semiconductor switch 3 are closed) on the basis of the detection result of the voltage detecting unit 8*g*.

However, there is concern that a through current may occur due to the open state of both of the first semiconductor switch 2 or the second semiconductor switch 3 and the fourth semiconductor switch 5 as the fourth semiconductor switch 5 is installed. Therefore, in the fuel injection valve driving device S of the embodiment, the Ipeak control unit 8*b* and the Ihold control unit 8*c* switch the first semiconductor switch 2 or the second semiconductor switch 3 from the closed state to the open state after detecting that the fourth semiconductor switch 5 has been switched from the open state to the closed state on the basis of the gate voltage of the fourth semiconductor switch 5 input from the voltage detecting unit 8*g*.

Figure 3A:
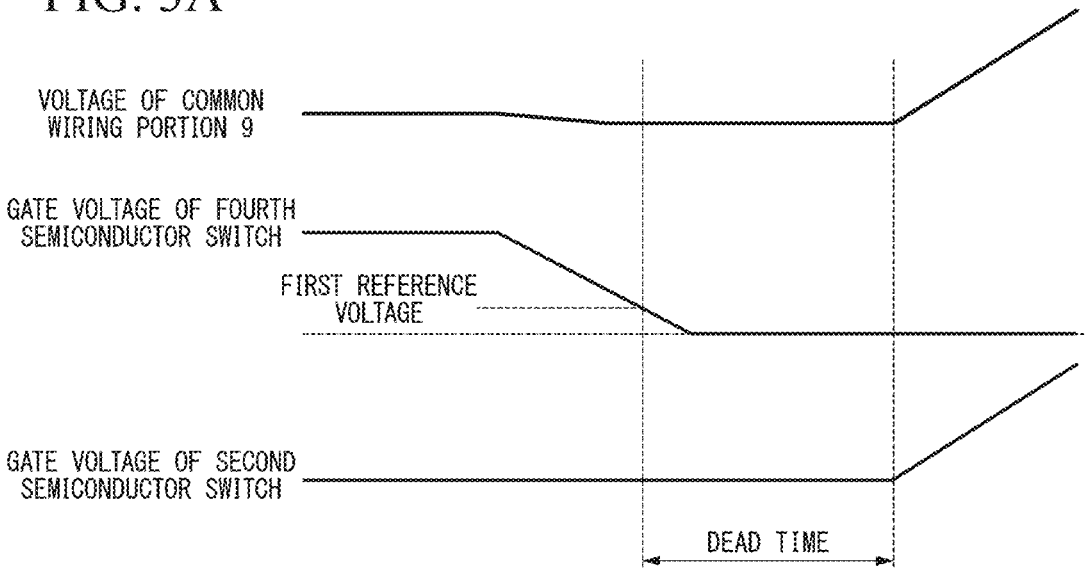
FIG. 3A is a timing chart showing change in voltage when a fourth semiconductor switch is switched from an open state to a closed state and a second semiconductor switch is switched from a closed state to an open state.

FIG. 3A is a timing chart showing temporal change in the voltage of the common wiring portion 9, the gate voltage of the fourth semiconductor switch 5, and the gate voltage of the second semiconductor switch 3, when the fourth semiconductor switch 5 is switched from the open state to the closed state and the second semiconductor switch 3 is switched from the closed state to the open state. Furthermore, in the explanation with reference to FIG. 3A, the first semiconductor switch 2 is normally in the closed state. Further, FIG. 3A is a diagram showing a very short time between a state in which the semiconductor switch starts to be turned off and a state in which the semiconductor switch is turned off. The Ihold control unit 8*c* sets the second semiconductor switch 3 to the open state after waiting for a predetermined dead time to elapse when the gate voltage of the fourth semiconductor switch 5 input from the voltage detecting unit 8*g* decreases to a first reference voltage indicating that the fourth semiconductor switch 5 has been brought into the closed state. Furthermore, when the fourth semiconductor switch 5 is switched from the open state to the closed state and the first semiconductor switch 2 is switched from the closed state to the open state, the Ipeak control unit 8*b* performs the same operation as that of the Ihold control unit 8*c*.

Figure 3B:
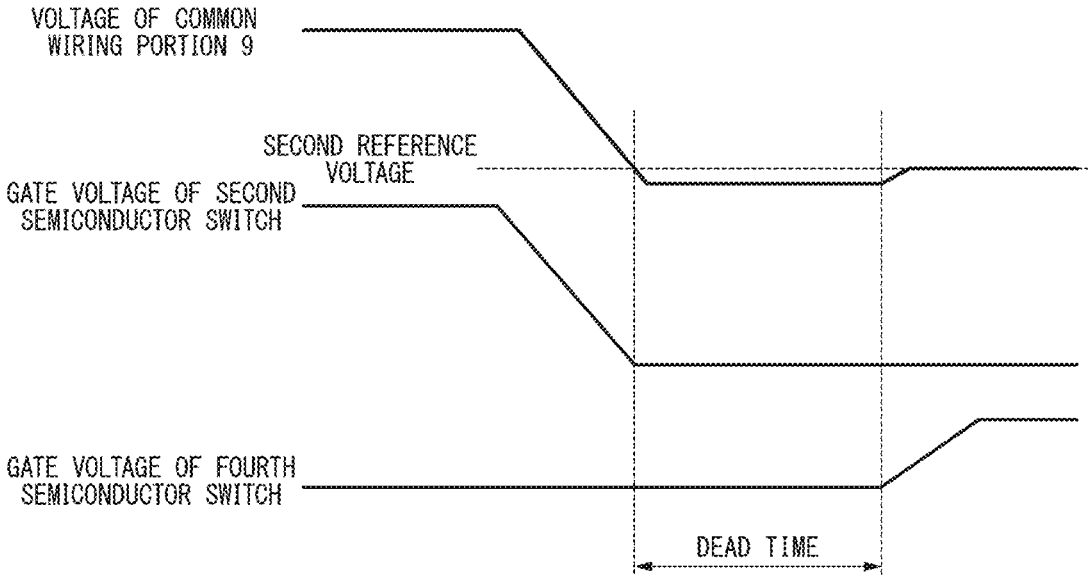
FIG. 3B is a timing chart showing change in voltage when the second semiconductor switch is switched from an open state to a closed state and the fourth semiconductor switch is switched from a closed state to an open state.

FIG. 3B is a timing chart showing temporal change in the voltage of the common wiring portion 9, the gate voltage of the fourth semiconductor switch 5, and the gate voltage of the second semiconductor switch 3, when the second semiconductor switch 3 is switched from the open state to the closed state and the fourth semiconductor switch 5 is switched from the closed state to the open state. Furthermore, in the explanation with reference to FIG. 3B, the first semiconductor switch 2 is normally in the closed state.

Further, FIG. 3B is a diagram showing a very short time between a state in which the semiconductor switch starts to be turned off and the semiconductor switch is turned off. The recirculation control unit 8*e* sets the fourth semiconductor switch 5 to the open state after waiting for a predetermined dead time to elapse when the voltage of the common wiring portion 9 input from the voltage detecting unit 8*g* (that is, the source voltage of the second semiconductor switch 3) decreases to a second reference voltage. Furthermore, when the first semiconductor switch 2 is switched from the open state to the closed state and the fourth semiconductor switch 5 is switched from the closed state to the open state, the Ipeak control unit 8*b* performs the same operation as that of the Ihold control unit 8*c* described herein.

Next, an operation of the fuel injection valve driving device S with such a configuration will be described with reference to FIG. 4.

Figure 4:
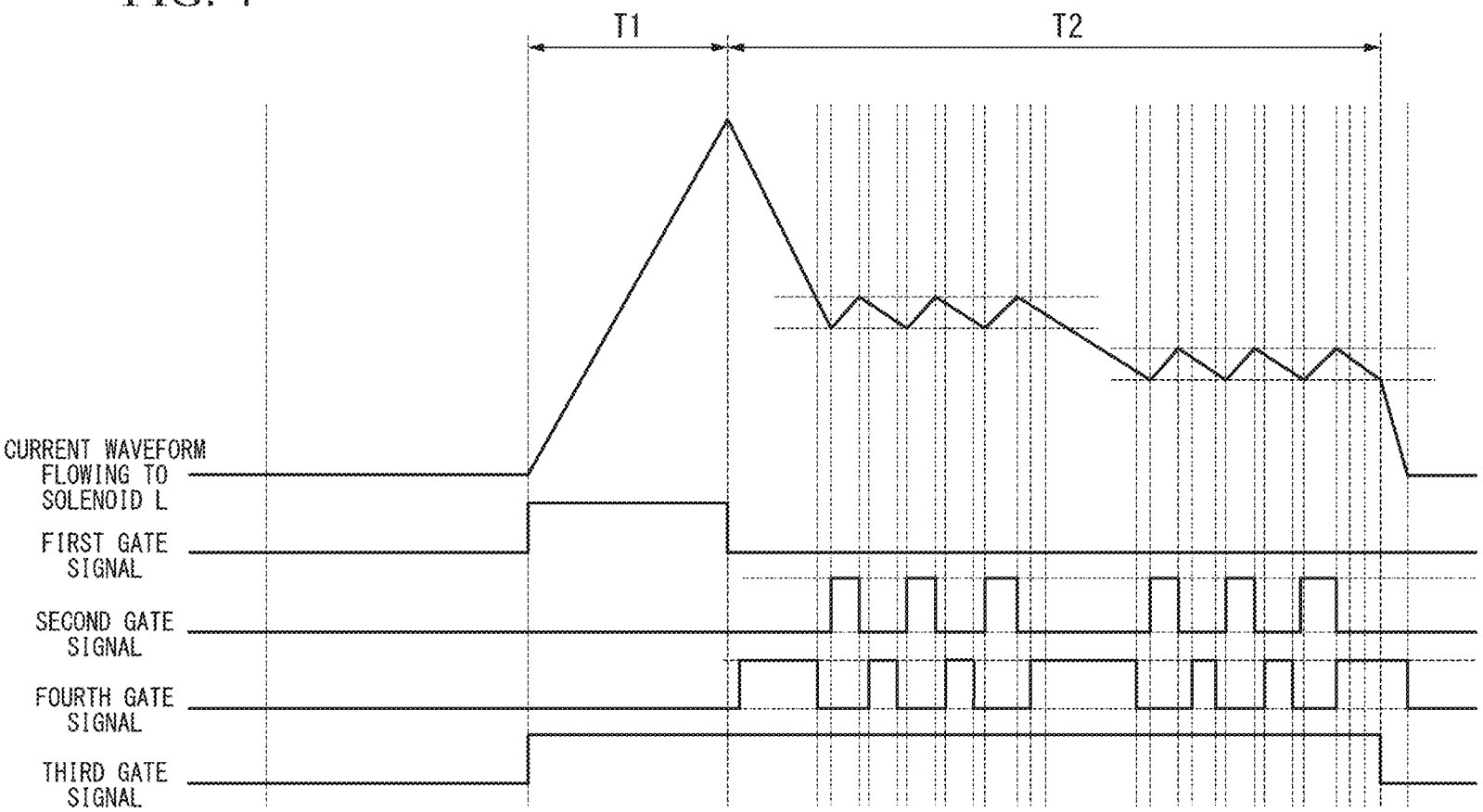
FIG. 4 is a timing chart showing an operation of the fuel injection valve driving device according to an embodiment of the present invention.

When the fuel injection valve is driven from the closed state to the open state by the fuel injection valve driving device S of the embodiment, the control unit 8 supplies the boosted voltage generated by the booster circuit 1 in an initial period T1 at the time of starting the driving to the solenoid L and supplies the battery voltage to the solenoid L in a holding period T2 after the initial period T1 as shown in FIG. 4.

That is, in the initial period T1, the Ipeak control unit 8*b* outputs the first gate signal to the first semiconductor switch 2 so as to supply the boosted voltage generated by the booster circuit 1 to one end of the solenoid L (one end of the solenoid coil), and the INJ switch control unit 8*d* outputs the third gate signal to the third semiconductor switch 4 so as to connect the other end of the solenoid L (the other end of the solenoid coil) to the ground G through the current detecting resistor 6.

As a result, in the initial period T1, a high boosted voltage is supplied to the solenoid L so that a peak rising current flows to the solenoid L. Such a peak rising current speeds up the opening operation of the fuel injection valve.

Then, in the holding period T2, the Ihold control unit 8*c* outputs the second gate signal to the second semiconductor switch 3 so as to supply the battery power to one end of the solenoid L (one end of the solenoid coil), and the INJ switch control unit 8*d* outputs the third gate signal to the third semiconductor switch 4 so as to connect the other end of the solenoid L (the other end of the solenoid coil) to the ground G through the current detecting resistor 6.

As a result, in the holding period T2, the battery voltage is supplied to the solenoid L. Here, since the Ihold control unit 8*c* supplies a PWM signal of a predetermined duty ratio to the second semiconductor switch 3 as the second gate signal, the battery voltage is intermittently supplied to the solenoid L. Further, the duty ratio is set on the basis of the magnitude of the driving current detected by the current detecting unit 8*f*. That is, the Ihold control unit 8*c* performs a feed-back control so that the magnitude of the driving current is maintained at a predetermined target value by setting the duty ratio of the PWM signal on the basis of the magnitude of the driving current detected by the current detecting unit 8*f*.

As a result, a holding current that maintains a predetermined target value is supplied to the solenoid L so that the fuel injection valve is maintained in the open state. Further, the holding current can be gradually changed by changing the duty ratio of the holding period T2 in two stages.

Further, the fourth semiconductor switch 5 is opened during a period in which all of the first semiconductor switch 2 and the second semiconductor switch 3 are closed (a period in which all of the first gate signal and the second gate signal are low, that is, a voltage at which the semiconductor switch is closed or less) in the initial period T1 and the holding period T2. Furthermore, the third semiconductor switch 4 is maintained in the open state. As a result, the counter electromotive current occurring in the solenoid L flows to the ground G through the ground G, the fourth semiconductor switch 5, the parasitic diode of the fourth semiconductor switch 5, the solenoid L, the third semiconductor switch 4, and the current detecting resistor 6.

Further, in the fuel injection valve driving device S of the embodiment, a predetermined period after the supply of the driving current to the solenoid L is set as the valve closing detection period and in this period, all of the first semiconductor switch 2, the second semiconductor switch 3, and the third semiconductor switch 4 are closed and the fourth semiconductor switch 5 is opened. During this time, since the voltage of the other end of the solenoid L changes with time, the valve closing detecting unit 8*h* of the control unit 8 detects the closing of the fuel injection valve on the basis of a change in voltage of the other end of the solenoid L.

In the fuel injection valve driving device S of the embodiment described above, since the first semiconductor switch 2 and the second semiconductor switch 3 are closed and the fourth semiconductor switch 5 is opened, the counter electromotive current occurring in the solenoid L can be returned to the solenoid L and one end side of the solenoid L is clamped to the reference potential of the ground. As a result, since a change in voltage of the solenoid L occurs only at the other end side of the solenoid L, it is possible to more accurately detect the closing of the fuel injection valve as compared with a case in which one end side is not clamped to the reference potential.

Further, in the fuel injection valve driving device S of the embodiment, the control unit 8 switches the first semiconductor switch 2 or the second semiconductor switch 3 from the closed state to the open state after detecting that the fourth semiconductor switch 5 has been switched from the open state to the closed state. For this reason, it is possible to prevent a through current from flowing from the booster circuit 1 or the battery to the ground G when the fourth semiconductor switch 5 is switched from the open state to the closed state and the first semiconductor switch 2 or the second semiconductor switch 3 is switched from the closed state to the open state.

Further, in the fuel injection valve driving device S of the embodiment, the fourth semiconductor switch 5 is the field effect transistor and the control unit 8 detects that the fourth semiconductor switch 5 has been switched from the open state to the closed state on the basis of the gate voltage of the fourth semiconductor switch 5. For this reason, according to the fuel injection valve driving device S of the embodiment, it is possible to reliably detect the open/closed state of the fourth semiconductor switch 5.

Further, in the fuel injection valve driving device S of the embodiment, the control unit 8 switches the fourth semiconductor switch 5 from the closed state to the open state after detecting that the first semiconductor switch 2 and the second semiconductor switch 3 are closed. For this reason, it is possible to prevent a through current from flowing from the booster circuit 1 or the battery to the ground G when the first semiconductor switch 2 or the second semiconductor switch 3 is switched from the open state to the closed state and the fourth semiconductor switch 5 is switched from the closed state to the open state.

Further, in the fuel injection valve driving device S of the embodiment, the first semiconductor switch 2 and the second semiconductor switch 3 are the field effect transistors and the control unit 8 detects that the first semiconductor switch 2 and the second semiconductor switch 3 are closed on the basis of the voltage of the common wiring portion 9 connected to the source terminal of the first semiconductor switch 2 and the source terminal of the second semiconductor switch 3. The voltage of the common wiring portion 9 decreases when both of the first semiconductor switch 2 and the second semiconductor switch 3 are closed. For this reason, it is possible to reliably detect that both of the first semiconductor switch 2 and the second semiconductor switch 3 are closed on the basis of the voltage of the common wiring portion 9.

Further, according to the fuel injection valve driving device S of the embodiment, when the fourth semiconductor switch 5 is opened, one end of the solenoid L is clamped to the reference potential. For this reason, when the control unit 8 has a built-in single-end amplifier that takes the reference potential and the other end of the solenoid L having a change in voltage, the closing of the valve can be detected by the output from the single-end amplifier. For example, in Japanese Patent Publication No. 6383760 described above, an active filter is configured by installing a large differential amplifier with a high withstand voltage outside the control unit in order to more accurately detect the closing of the valve. In contrast, according to the fuel injection valve driving device S of the embodiment, since it is possible to accurately detect the closing of the valve using the single-end amplifier built into the control unit 8, there is no need to install a large differential amplifier separately from the control unit 8. As a result, it is possible to realize a decrease in size of the device.

As described above, a preferred embodiment of the present invention has been described with reference to the accompanying drawings, but it is needless to mention that the present invention is not limited to the above-mentioned embodiment. A combination of the components shown in the above-mentioned embodiment is an example and can be modified into various forms on the basis of the design requirements or the like in a scope not departing from the spirit of the present invention.

For example, in the above-mentioned embodiment, the counter electromotive force is mainly consumed as heat due to the boost regeneration diode 10 and the solenoid L in the recirculation path. Furthermore, this is also possible with an active clamp circuit including a Zener diode and a diode provided between the drain terminal and the gate terminal of the third semiconductor switch 4.

Furthermore, the slope of the bending point of the graph of FIG. 2 changes depending on the member or various shapes of the solenoid.

Further, the fourth semiconductor switch 5 is opened after detecting that the voltage of the common wiring portion 9 has decreases (the first semiconductor switch 2 and the second semiconductor switch 3 are closed), but the fourth semiconductor switch 5 may be opened after detecting that the gate voltage of the first semiconductor switch 2 and the gate voltage of the second semiconductor switch have become equal to or smaller than a voltage at which the semiconductor switch is closed (the first semiconductor switch 2 and the second semiconductor switch 3 are closed).

For example, in the period T2 of FIG. 4 of the above-mentioned embodiment, a relatively large current for preventing the closing of the valve due to the rebound of the valve connected to the solenoid, and a relatively small current necessary for maintaining the valve in the open state are switched, but one type of current that is relatively large to prevent the valve from closing due to the rebound of the valve connected to the solenoid may be used.

EXPLANATION OF REFERENCES

1 Booster circuit
2 First semiconductor switch (first switching element)
3 Second semiconductor switch (second switching element)
4 Third semiconductor switch (third switching element)
5 Fourth semiconductor switch (fourth switching element)
6 Current detecting resistor
7 Backflow preventing diode
8 Control unit
G Ground
L Solenoid
S Fuel injection valve driving device
10 Boost regeneration diode
11 Overcurrent detecting resistor

What is claimed is:

1. A fuel injection valve driving device for driving a fuel injection valve with a solenoid, comprising:

a first switching element which is disposed between a booster circuit boosting a battery power and one end of the solenoid;

a second switching element which is disposed between a battery and one end of the solenoid;

a third switching element which is disposed between an other end of the solenoid and a ground;

a fourth switching element which is disposed between one end of the solenoid and a ground; and a control unit which is configured to control ON/OFF states of the first switching element, the second switching element, the third switching element, and the fourth switching element, wherein the control unit is configured to turn on the fourth switching element during a valve closing detection period of detecting closing of the fuel injection valve to clamp the one end of the solenoid to a reference potential of a ground and to detect the closing of the fuel injection valve based on a change in voltage of the other end of the solenoid, the valve closing detection period being a predetermined period before and after an estimated time at a moment when a valve body collides with a valve seat.

2. The fuel injection valve driving device according to claim 1, wherein the control unit is configured to switch the fourth switching element from an OFF state to an ON state after detecting that the first switching element and the second switching element are tuned off.

3. The fuel injection valve driving device according to claim 1, wherein the control unit is configured to switch the first switching element or the second switching element from an OFF state to an ON state after detecting that the fourth switching element has been switched from an ON state to an OFF state.

4. The fuel injection valve driving device according to claim 1, wherein the fourth switching element is a field effect transistor, and the control unit is configured to detect that the fourth switching element is turned off based on a gate voltage of the fourth switching element.

5. The fuel injection valve driving device according to claim 1, wherein the OFF state of the first switching element and the second switching element is detected based on a voltage of a wiring on the side of the solenoid commonly connected to the first switching element and the second switching element.

6. The fuel injection valve driving device according to claim 1, wherein the first switching element and the second switching element are field effect transistors, and the control unit is configured to detect that the first switching element or the second switching element is turned off based on a voltage of a wiring connected to a gate terminal of the first switching element and a gate terminal of the second switching element.

7. The fuel injection valve driving device according to claim 1, further comprising:

an overcurrent detecting resistor which is disposed between a connection position between a source terminal of the first switching element and a source terminal of the second switching element, and a connection position between one end of the solenoid and a drain terminal of the fourth switching element.

* * * * *